US008640622B2

(12) United States Patent
Eckstein

(10) Patent No.: US 8,640,622 B2
(45) Date of Patent: Feb. 4, 2014

(54) TANDEM NESTED PROJECTILE ASSEMBLY

(76) Inventor: Donald B. Eckstein, Burke, VA (US)

( * ) Notice: Subject to any disclaimer, the term of this patent is extended or adjusted under 35 U.S.C. 154(b) by 0 days.

(21) Appl. No.: 13/298,672

(22) Filed: Nov. 17, 2011

(65) Prior Publication Data

US 2012/0266772 A1 Oct. 25, 2012

Related U.S. Application Data

(60) Provisional application No. 61/478,139, filed on Apr. 22, 2011.

(51) Int. Cl.
*F42B 12/64* (2006.01)

(52) U.S. Cl.
USPC ..... 102/506; 102/438; 102/439; 102/517; 102/703

(58) Field of Classification Search
USPC ..... 102/506, 517, 518, 438, 439, 377, 378, 102/703
See application file for complete search history.

(56) References Cited

U.S. PATENT DOCUMENTS

| | | | | | |
|---|---|---|---|---|---|
| 3,450,050 | A * | 6/1969 | Robinson | 102/506 |
| 3,680,485 | A * | 8/1972 | Zaid et al. | 102/506 |
| 3,802,345 | A * | 4/1974 | La Costa | 42/78 |
| 3,862,600 | A * | 1/1975 | Tocco | 102/438 |
| 4,777,882 | A * | 10/1988 | Dieval | 102/489 |
| 4,922,826 | A * | 5/1990 | Busch et al. | 102/489 |
| 5,796,031 | A * | 8/1998 | Sigler | 102/520 |
| 7,806,053 | B1 * | 10/2010 | King et al. | 102/517 |
| 8,191,478 | B2 * | 6/2012 | Herbage et al. | 102/352 |
| 8,250,987 | B1 * | 8/2012 | Morley et al. | 102/506 |
| 2012/0234198 | A1 * | 9/2012 | Carmel | 102/438 |

* cited by examiner

*Primary Examiner* — James Bergin
(74) *Attorney, Agent, or Firm* — Robert M. Downey, P.A.

(57) ABSTRACT

A projectile assembly 10 includes an individual projectile 20 and a composite projectile 30. The individual projectile 20 has a communicating portion 22. The composite projectile 30 includes at least one flechette 32. Prior to the projection of the projectile assembly 10, the composite projectile 30 is located adjacent to the communicating portion 22 of the individual projectile 20. The individual projectile 20 and the composite projectile 30 are structured and disposed for separating from one another after the initial projection of the projectile assembly 10.

32 Claims, 10 Drawing Sheets

TANDEM NESTED PROJECTILE ASSEMBLY

This non-provisional patent application is based on provisional patent application Ser. No. 61/478,139 filed on Apr. 22, 2011.

BACKGROUND

Some embodiments discussed herein may relate to projectiles to be fired from a weapon.

There currently exists no practical method for firing projectiles from firearms that include flechettes. The use of flechettes may allow for many known and unknown advantages against certain types of targets.

In light of the lack of current flechette-inclusive projectiles, there is a desperate need for a projectile assembly that may combine the effects of a standard projectile with the effects of multiple flechettes.

In this specification where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is it known to be relevant to an attempt to solve any problem with which this specification is concerned.

SUMMARY

The term "Tandem Nested Projectile Assembly" as used herein refers to some embodiments of the claims and may be abbreviated as "TNPA." The use of the term "Tandem" is herein defined as "a group of two or more arranged adjacent to one another or used or acting in conjunction." The use of the term "Nested" is herein defined as "to fit together or to fit compactly together or to fit within one another." It is noted that the use of the term "Nested" does not preclude the possibility of a tandem projectile that does not have any components housed within or contained within other components. Instead, the term "Nested" should only be taken at its broadest meaning to imply that one or more components communicate with each other in adjacent arrangement at some point in time. The use of the terms "Tandem" and "Nested" do not necessarily imply that the projectile assembly is always acting in Tandem and being Nested, only that these modifiers may be true at one or more points in time.

Some embodiments may address one or more of the problems and deficiencies discussed above. However, it is contemplated that some embodiments may prove useful in addressing other problems and deficiencies in a number of technical areas. Therefore the claims should not necessarily be construed as limited to addressing any of the particular problems or deficiencies discussed herein.

Some embodiments may include a projectile assembly having an individual projectile and a composite projectile. The individual projectile has a communicating portion. The composite projectile includes at least one flechette. Prior to the projection of the projectile assembly, the composite projectile is located adjacent to the communicating portion of the individual projectile. The individual projectile and the composite projectile are structured and disposed for separating from one another after the initial projection of the projectile assembly.

Some Advantages of Some Embodiments

Some of the advantages that may be provided by some embodiments are detailed below. Other advantages may additionally be provided by some embodiments and are envisioned to be provided under the scope of the attached claims.

Current 7.62 mm rounds have a weight and volume approximately twice that of current 5.56 mm rounds; doubling the number of 7.62 mm projectiles per cartridge negates one of the primary reasons 5.56 mm rounds were adopted. However, the 7.62 mm TNPA design does not just double the number of projectiles—it allows each of the two projectiles to be optimized for separate functions. This means that one 7.62 mm TNPA round not just equivalent to two 5.56 mm rounds; it means that each of the 7.62 mm TNPA projectiles could be significantly more effective than two standard 5.56 mm projectiles. While 7.62 mm cartridges are roughly twice as expensive as 5.56 mm cartridges, a 7.62 mm TNPA round may only be about 10 percent (cost of the extra internal primer and base bleed propellant) more expensive to manufacture, and may not require any special handing, or modifications to 7.62 mm weapons.

All assault rifles and machine guns have a cyclic rate of fire—so many rounds per minute, usually 500-600. Rifles and machine guns armed with TNPA rounds may have approximately twice the effective rate of fire, without any weapons modifications, since each round fired is actually launching multiple projectiles instead of only one. Since continuous firing generates a lot of heat, most training programs stress the need to fire in bursts of several rounds at a time. Some assault rifles in have a burst fire position on the safety switch, with three rounds being typical. When loaded with the TNPA round, a single shot sends at least two projectiles downrange, at least doubling the rate of fire; a "double tap" would therefore send at least four projectiles downrange, at least two designed for soft targets, and at least two for hard targets. Another way to look at the TNPA advantage is that an M-4 normally has a 30 round magazine, while an equivalent 7.62 mm assault rifle has a 20 round magazine. However, the 20 round 7.62 mm equipped with TNPAs will send at least 40 projectiles downrange—at least a thirty-three percent increase over the M-4 using standard projectiles. In addition, assault rifle and machine guns are generally rated to fire a specific number of rounds before their barrels are replaced; this same observation applies to the entire weapon. With a TNPA round, the weapon is subjected to the normal wear and tear of single round ammunition but at least twice as many rounds go downrange, significantly reducing long term logistic costs.

These and other advantages of some embodiments are more readily apparent with reference to the detailed description and accompanying drawings.

BRIEF DESCRIPTION OF THE DRAWINGS

For a fuller understanding of the nature of some embodiments, reference should be made to the following detailed description taken in conjunction with the accompanying drawings in which.

Like reference numerals refer to like parts throughout the several views of the drawings.

DETAILED DESCRIPTION OF SOME EMBODIMENTS

Unless otherwise defined, all terms, and especially any technical and/or scientific terms, used herein may be taken to have the same meaning as commonly understood by one having an ordinary skill in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Unless otherwise specified, one or more particular features and/or elements described in connection with one or more embodiments may be found in one embodiment, or may be found in more than one embodiment, or may be found in all embodiments, or may be found in no embodiments.

Any and all details set forth herein are used in the context of some embodiments and therefore should NOT be necessarily taken as limiting factors to the attached claims. Any descriptions of elements and/or features and/or the materials used to create those elements or features, or examples or methods included in the descriptions of the various embodiments are nonlimiting and are given as an illustration only. Accordingly, the embodiments can be manufactured, distributed, used, practiced, and carried out in numerous ways.

The attached claims and their legal equivalents can be realized in the context of embodiments other than the ones used as illustrative examples in the description herein.

Referring to the several views of the drawings, the projectile assembly is shown in accordance with at least one embodiment of the invention. In each of the several views, the projectile assembly is generally indicated as 10.

Figure 1:
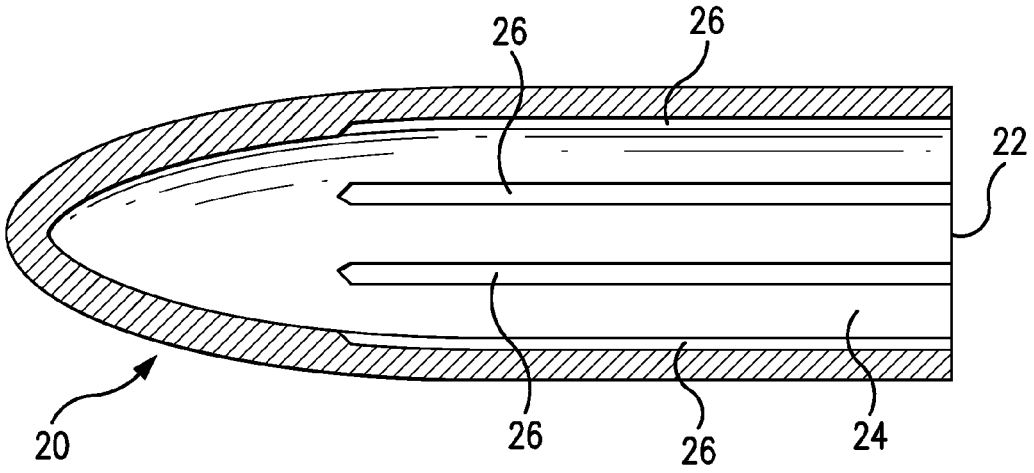
FIG. 1 is a side cross-sectional view of the individual projectile according to an embodiment.

Reference is now made to FIG. 1. An individual projectile 20 includes a communicating portion 22. In one or more embodiments, the communicating portion 22 may be a cavity 22, as shown in the drawings. The terms "communicating portion" and "cavity" are interchangeable herein, and the implications of the term "cavity" do not limit the scope of the term "communicating portion" in any way, as a "cavity" is only shown to illustrate a possible example in a possible embodiment having a communicating portion. The individual projectile 20 may include a communicating surface 24 having scores 26. Scores 26 create areas of weakness in the projectile 20 such that, when the projectile 20 is projected and subsequently impacts on a target, the force of impact will cause the projectile 20 to shatter along the scores 26. In this manner, the likelihood of the "fragmentation" of the projectile 20 is increased. Fragmentation of the projectile 20 causes the projectile 20 to be particularly suited for damaging soft targets, such as human flesh. Upon impact with a soft target, the projectile 20 is shattered into multiple fragments that spread throughout the target thereby causing more damage than a single, non-fragmenting projectile would be capable of. In some embodiments, the anti-personnel projectile may be made from a soft metal, such as copper and/or lead etc. in order to increase the capability of the projectile to deform and to promote expansion of the projectile 20 upon impact with a target. Expansion of the projectile 20 increases the size of the impact on a target, and increases the energy transfer to the target thereby causing more damage to the target.

Figure 2:
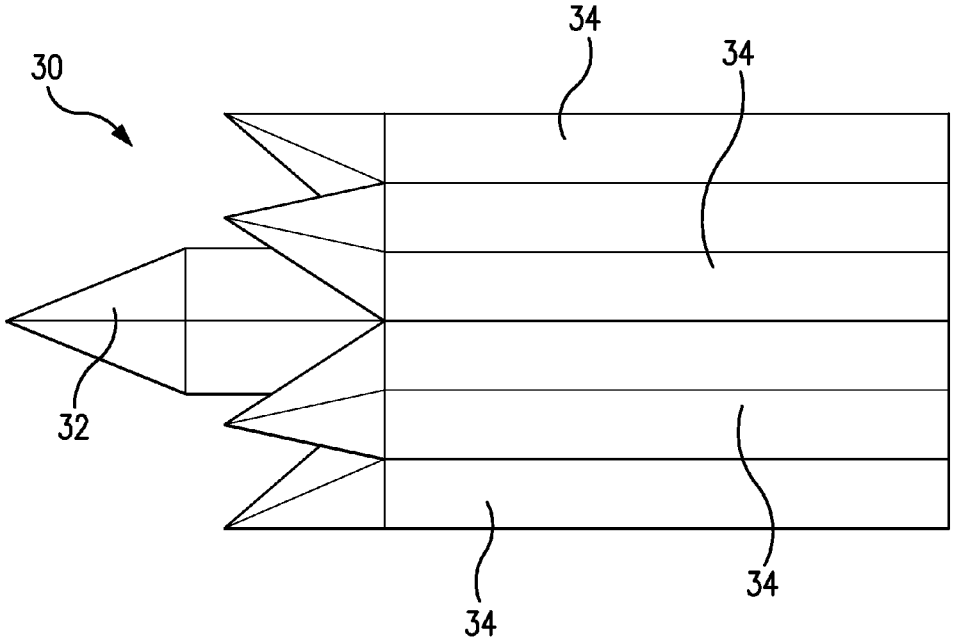
FIG. 2 is a side elevational view of the composite projectile according to an embodiment.

Additional reference is now made to FIG. 2. A composite projectile 30 includes a core flechette 32 surrounded by multiple side flechettes 34. The side flechettes 34 are adhered to the core flechette 32 through any means of adhering, including but not limited to using an adhesive. The adhesive may be a low strength adhesive capable of withstanding the centrifugal forces of spinning and high-speed projectile flight, but not capable of withstanding impact with a target, such that upon impact with a target, the side flechettes 34 may separate from the core flechette 32 and disperse through the target. The flechettes are designed to penetrate a target due to a predetermined size and shape, and are also designed to come to rest while still inside their target, as opposed to travelling entirely through and out of their target, due to their predetermined mass.

Figure 3:
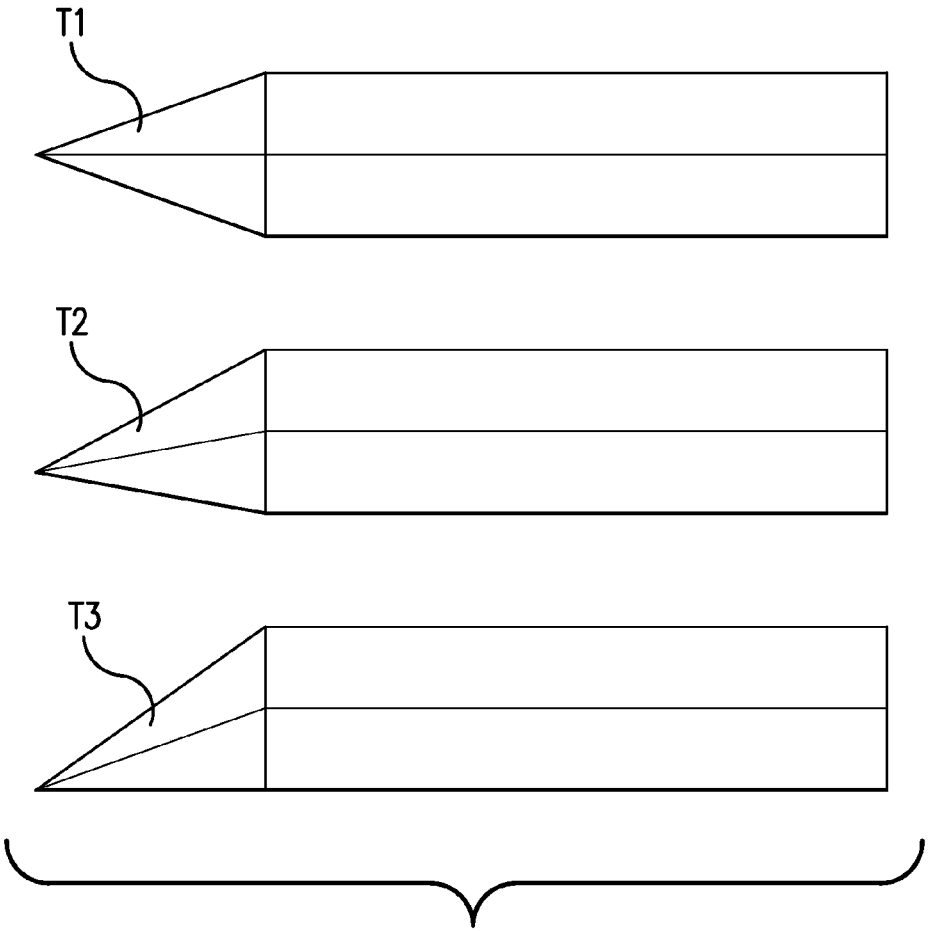
FIG. 3 is a side elevational view of some various shapes of flechette tips according to one or more embodiments.

Additional reference is now made to FIG. 3. The core flechette 32 and/or side flechettes 34 may use a variety of different tip shapes in order to change their trajectory leading up to and/or through a target. Conical tip T1 is the standard shape for a core flechette 32 and is well known as the standard tip shape for projectiles in general. Conical tip T1 promotes a straightforward trajectory with minimal dispersing. Angled tip T2 is similar to the conical tip T1; however the point of the tip is aimed slightly off-center. Angled tip T2 promotes a small amount of dispersion away-from-center. Chisel tip T3 promotes the highest level of dispersion from center during penetration of a target. Side flechettes 34 have chisel tips T3 according to an embodiment.

Figure 4:
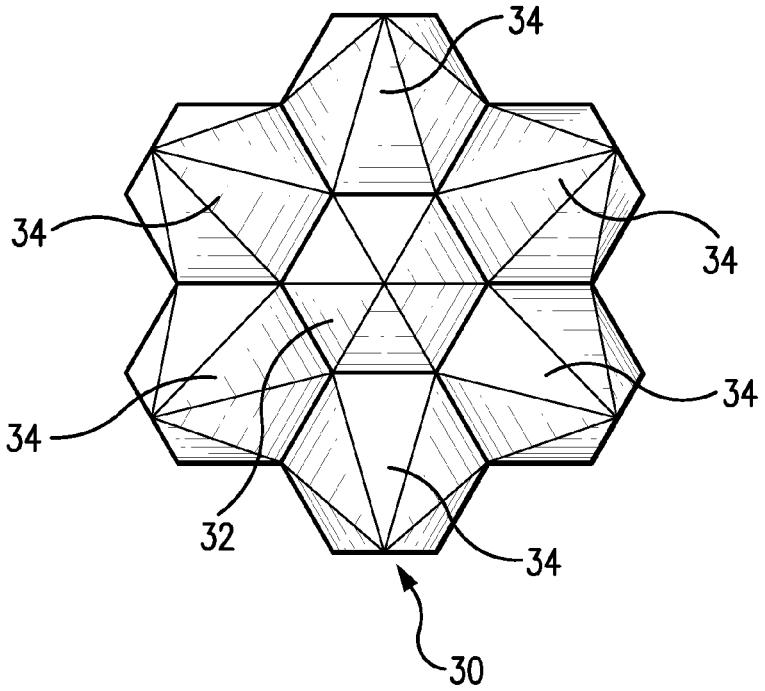
FIG. 4 is a front elevational view of the composite projectile according to the embodiment of FIG. 2.

Additional reference is now made to FIG. 4. The orientation of the side flechettes 34 around the core flechette 32 according to an embodiment can be seen from a front elevational view. The side flechettes 34 may be adhered to the core flechette 32, or they may be adhered to each other, or both, or neither.

Figure 5:
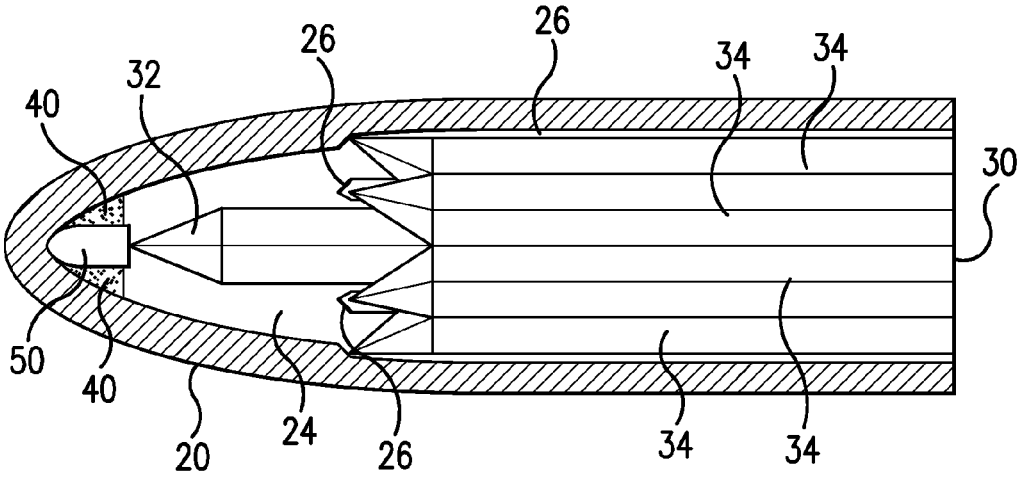
FIG. 5 is a side cross-sectional view of the projectile assembly according to an embodiment, wherein the composite projectile of FIG. 2 is in tandem with the individual projectile of FIG. 1.

Additional reference is now made to FIG. 5. The individual projectile 20 and the composite projectile 30 are now shown in tandem prior to being loaded into a weapon. The communicating surface 24 includes a primer 50 and a propellant 40. The core flechette 32 does not make contact with the primer 50 at the point of time in this view. The side flechettes 34 fit into the scores 26 such that radial spinning of the individual projectile 20 also causes the radial spinning of the composite projectile 30. The composite projectile 30 is located adjacent to or within the communicating portion 22 of the individual projectile 20 prior to the firing of the projectile assembly 10.

Reference is still made to FIG. 5 and in particular to the propellant 40 of FIG. 5. The propellant 40 is an explosive that is capable of being detonated. In some embodiments, the propellant 40 may be an explosive that is very powerful and having a low sensitivity thereby requiring a high amount of energy to detonate. The propellant 40 may be referred to as the "secondary explosive" of the projectile assembly 10. As shown in FIG. 5, the propellant 40 is located adjacent to both of the individual projectile 20 and the composite projectile 30, particularly it is located adjacent to the communicating portion 22 of the individual projectile 20, and even more particularly it is located within the cavity 22 of the individual projectile 20 in some embodiments. The propellant 40 is also located adjacent to the primer 50. When the propellant 40 is detonated, it pressurizes the space of the cavity 22 between the individual projectile 20 and the composite projectile 30. This pressurization applies a large force to both of the individual projectile 20 (in the forward direction of projectile motion) and the composite projectile 30 (in the reverse direction of projectile motion) thereby causing the composite projectile 30 to withdraw from the communicating portion 22 and thereby causing an increased separation between the individual projectile 20 and the composite projectile 30.

Reference is still made to FIG. 5 and in particular to the primer 50 of FIG. 5. The primer 50 is an explosive that is capable of being detonated. In some embodiments, the primer 50 may be an explosive that is relatively weak in strength and that is extremely sensitive thereby requiring very little energy to detonate. The primer 50 may be referred to as the "primary explosive" of the projectile assembly 10. In particular, some embodiments may have a primer 50 that is significantly more sensitive and less powerful than the propellant 40. The use of a primer 50 and a propellant 40 in combination provides an advantage, namely that the primary explosive (i.e. the propellant 40) may be an explosive formulated to be stable and safe to handle to reduce the likelihood that it will explode prematurely. Stable explosives such as the propellant 40 may be difficult to intentionally detonate, which is why the primer 50 is used. The primer 50 may be very unstable; however it may also not be very powerful. As shown in FIG. 5, the primer 50 is located adjacent to both of the individual projectile 20 and the composite projectile 30, particularly it is located adjacent to the communicating portion 22 of the individual projectile 20, and even more particularly it is located within the cavity 22 of the individual projectile 20 in some embodiments. The primer 50 is also located adjacent to the propellant 40. The primer 50 is intended to detonate when the composite projectile 30 inserts into and penetrates the primer 50, which occurs when the projectile assembly 10 is projected from a weapon. More specifically, in some embodiments, the firing of the projectile assembly 10 from a firearm causes the composite projectile 30 to move forward, further into the cavity 22 of the individual projectile 20. By moving forward, the composite projectile 30 penetrates and breaks into the primer 50. Because of its instability, this causes the primer 50 to detonate thereby providing the necessary activation energy to detonate the propellant 40 and thereby detonating the propellant 40. Therefore, it can be seen through a chain of causation that the projection of the projectile assembly 10 causes the detonation of the primer 50 that causes the detonation of the propellant 40 that causes the composite projectile 30 to withdraw from the communicating portion 22 of the individual projectile 20 thereby causing separation between the individual projectile 20 and the composite projectile 30.

Figure 6:
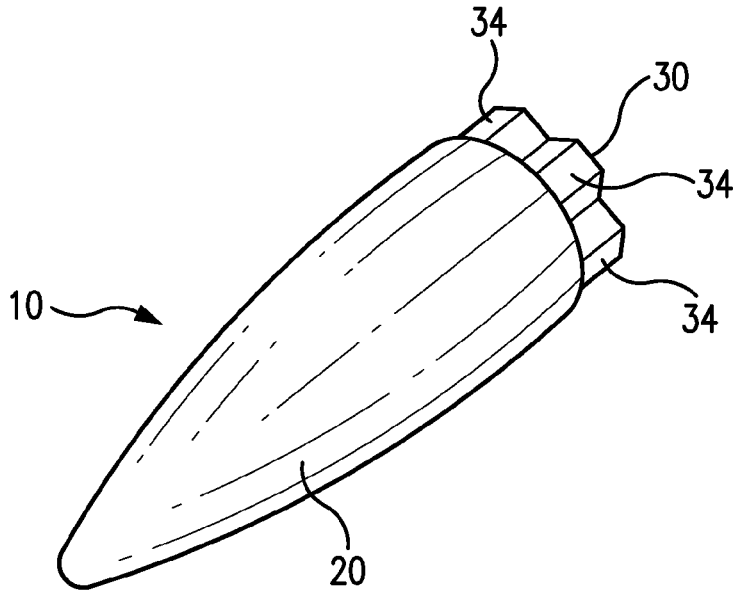
FIG. 6 is a perspective view of the projectile assembly according to an embodiment.

Additional reference is now made to FIG. 6. The projectile assembly 10 is shown in a perspective view prior to being loaded into a weapon.

Figure 7:
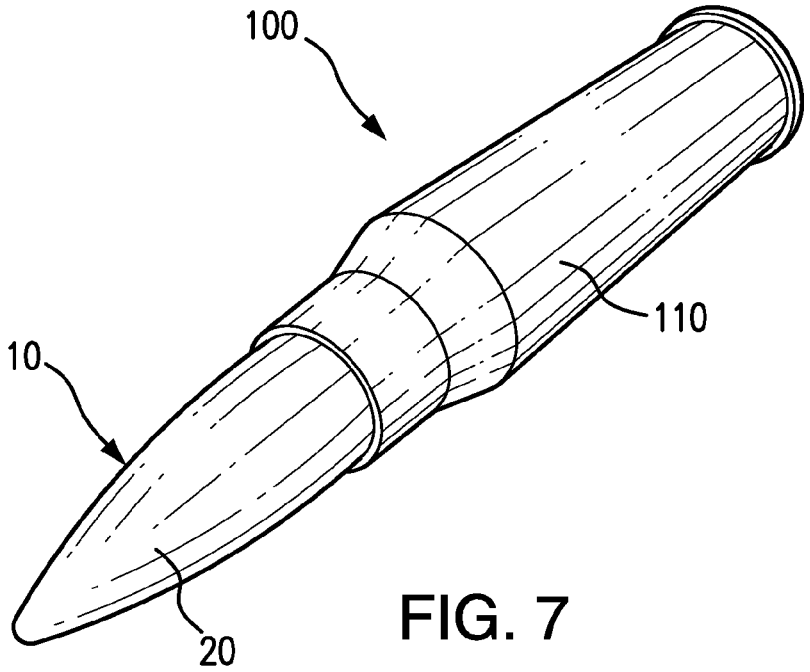
FIG. 7 is a perspective view of the projectile assembly of FIG. 6 shown loaded into a cartridge according to an embodiment.

Additional reference is now made to FIG. 7. The projectile assembly 10 is shown as part of a cartridge 100 in accordance with an embodiment. The cartridge 100 may include a case 110. The cartridge 100 is used for loading into a weapon; however after the weapon is fired, only the projectile assembly 10 actually travels downrange. The remainder of the cartridge 100, including the case 110, may be ejected from the weapon, as is well known in the art, or handled in any other suitable manner. The cartridge 100 (not including the projectile assembly 10) may be of any cartridge type. The projectile assembly 10 may be loaded into a cartridge 100 without needing to modify the cartridge 100. In some embodiments, the cartridge 100 may have a diameter of 7.62 mm, herein referred to as a "7.62 mm cartridge" or a "7.62 mm round."

Figure 8:
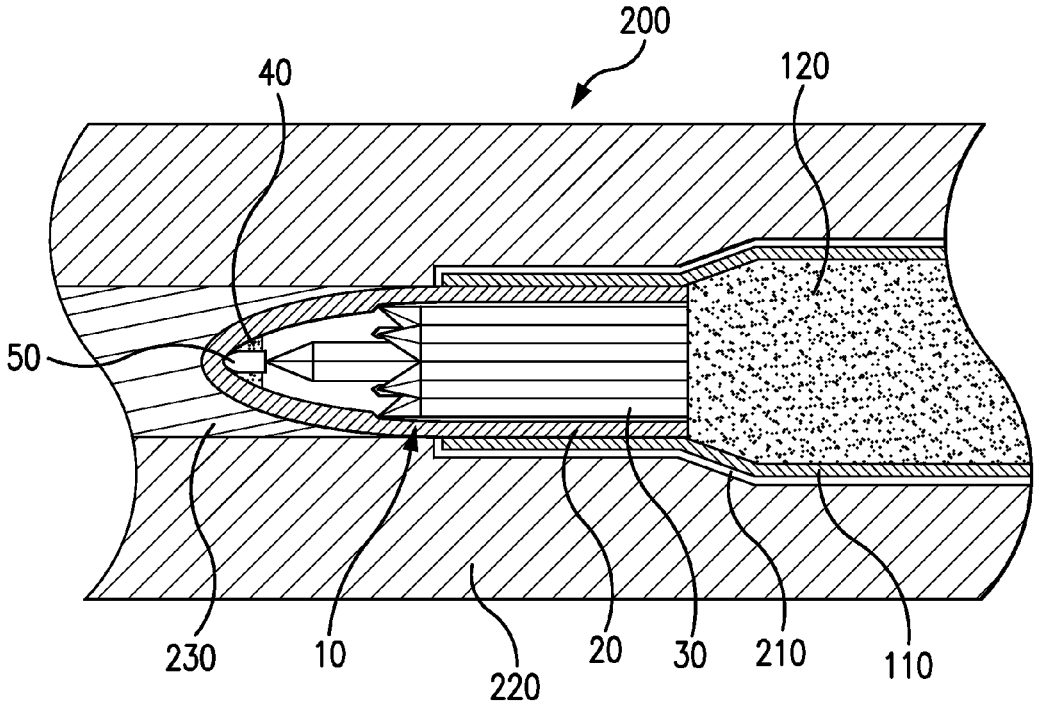
FIG. 8 is a side cross-sectional view of the projectile assembly loaded into a cartridge that is loaded into a firearm, according to an embodiment.

Additional reference is now made to FIG. 8. The projectile assembly 10 is now shown in a side cross-sectional view after being loaded into a weapon 200. The projectile assembly 10 is housed in the bore 230 within the barrel 220. The cartridge 100 is loaded into the chamber 210 prior to projecting the projectile assembly 10. The powder 120 of the cartridge 100 is shown. This powder 120 is detonated at the time of firing to project the projectile assembly 10 forward through the bore 230 of the barrel 220. At the time of detonation of the powder 120, the projectile assembly 10 separates from the case 110. Particularly of note is that in some embodiments, the diameter of the widest portion of the individual projectile 20 of the projectile assembly 10 is the same as the diameter of the bore 230 of the weapon 200 in order to allow a maximum force buildup behind the projectile assembly 10 (in the rear of the bore 230 and in the chamber 210) in order to project the projectile assembly 10 forward at the highest speed possible. The weapon 200 may be of any weapon type. The weapon 200 may be configured to fire a cartridge 100 having the projectile assembly 10 without any need to modify the cartridge 100 or the weapon 200. The weapon 200 may have a bore 230 with a diameter of 7.62 mm, such a weapon 200 being herein referred to as a "7.62 mm weapon." 7.62 mm weapons are configured for firing 7.62 mm rounds.

Figure 9:
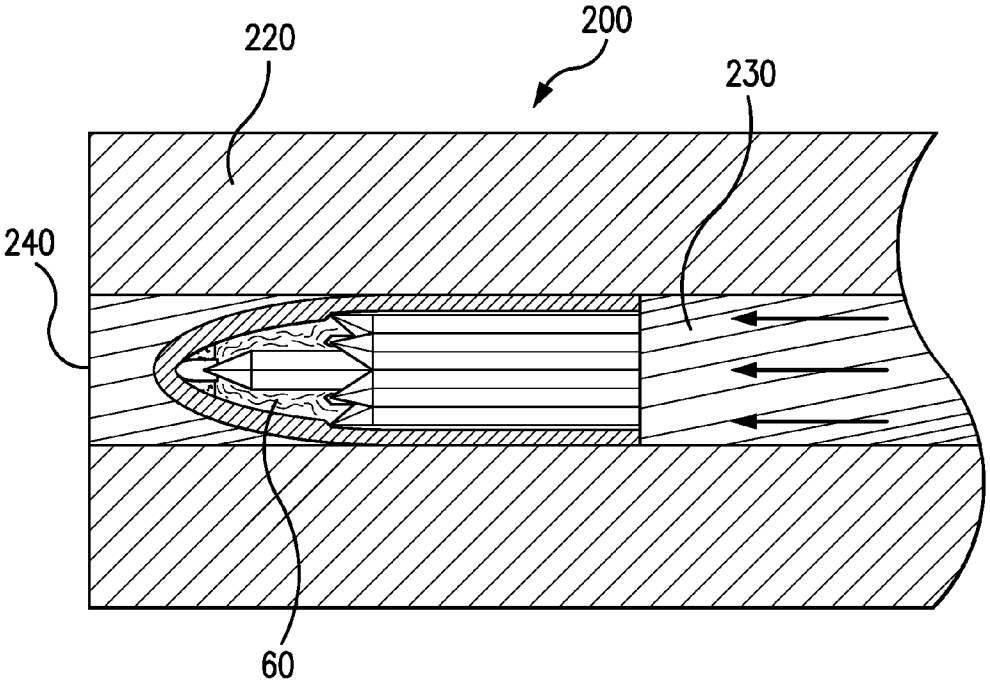
FIG. 9 is a side cross-sectional view of the projectile assembly after it has been projected and while it is still within the bore of the firearm, according to an embodiment.

Additional reference is now made to FIG. 9. The projectile assembly 10 is shown being fired down the bore 230 of the weapon 200. When the projectile assembly 10 is fired, the composite projectile 30 moves further into the cavity 22 of the individual projectile 20. When this happens, the core flechette 32 drives into the primer 50, causing the primer 50 to detonate. The detonation of the primer 50 causes the simultaneous detonation of the propellant 40, which increases the pressure of the cavity 22, pushing the composite projectile 30 backwards out of the cavity. In some embodiments, the propellant 40 may define a "base bleed gas generator" in which the detonation of the propellant 40 at the time of firing causes the emission of a base bleed gas 60. However, while the projectile assembly 10 is being projected down the bore 230 of the weapon 200, the bore 230 has an extremely high pressure as well, created from the explosion of the powder 120 in the cartridge 100. The projectile assembly 10 also experiences a strong force due to air resistance in front of the projectile assembly 10. These two forces keep the individual projectile 20 and composite projectile 30 "locked" together and prevent them from separating until the projectile assembly 10 actually leaves the bore 230 of the weapon 200. Therefore, despite the high pressure in the cavity 22 caused by the detonation of the propellant 40, the composite projectile 30 does not move out of the cavity 22 until the projectile assembly 10 has passed through the muzzle 240 of the weapon 200, as shown in the next view.

Figure 10:
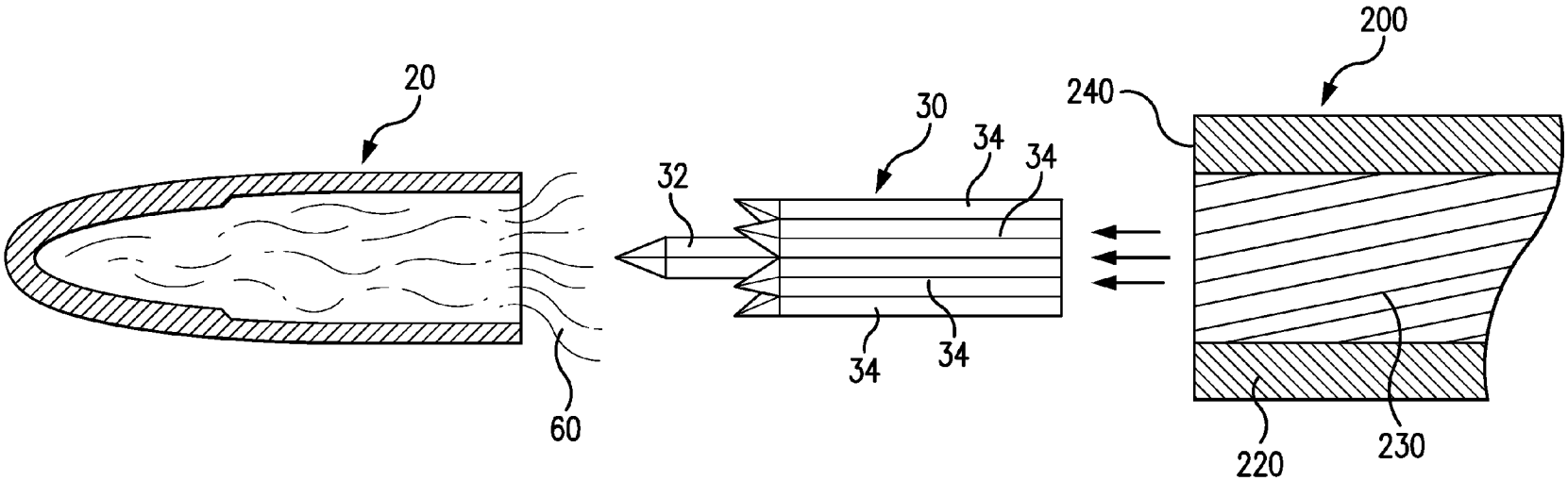
FIG. 10 is a side cross-sectional view of the projectile assembly after it has left the bore of the firearm, according to an embodiment.

Additional reference is now made to FIG. 10. The projectile assembly 10 is shown in elevational cross section after it has left the bore 230 and has completely passed through the muzzle 240. After the projectile assembly 10 completely passes through the muzzle 240, the composite projectile 30 experiences significantly less force from behind, since the pressure that had built up within the bore 230 is now capable of dispersing into the atmosphere. The base bleed gas 60 increases the pressure within the cavity 22 (thereby helping to "push" out the composite projectile 30 once the projectile assembly 10 leaves the bore 230). The pressure build-up within the cavity 22 due to the detonation of the propellant 40 and the build-up of base bleed gas 60, the composite projectile 30 is ejected from the cavity 22 such that the individual projectile 20 and the composite projectile 30 separate. After the two projectiles have separated, the base bleed gas 60 pours out of the cavity 22 and fills in the area behind the individual projectile 20. This area behind the individual projectile 20 normally contributes significantly to the drag experienced by the individual projectile 20, due to low pressure in the area and the tendency of the airflow surrounding the individual projectile 20 to try and fill in that low pressure area. The base bleed gas 60 that is released into this low pressure area behind the individual projectile 20 causes the area to increase in pressure, and therefore reduces the amount of drag that the individual projectile 20 experiences. This may partially or completely offset the difference in drag experienced by the individual projectile 20 and the composite projectile 30 due to differences in shape and size. The base bleed gas 60 is therefore capable of increasing the range of the individual projectile 20 by eliminating some of the drag experienced by the individual projectile 20.

Figure 11:
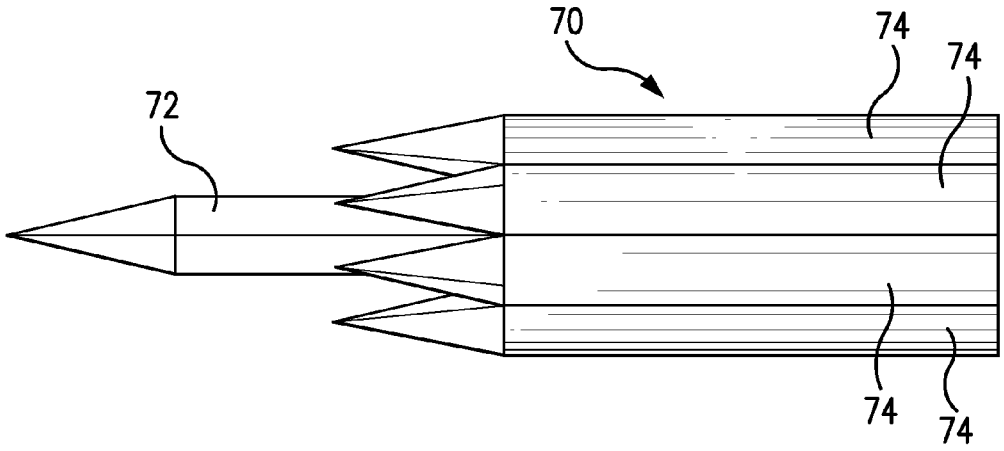
FIG. 11 is a side elevational view of the composite projectile according to another embodiment.

Additional reference is now made to FIG. 11. The composite projectile 70 of an alternate embodiment of the projectile assembly 10 is shown wherein the side flechettes 74 surrounding the core flechette 72 have angled tips T2.

Figure 12:
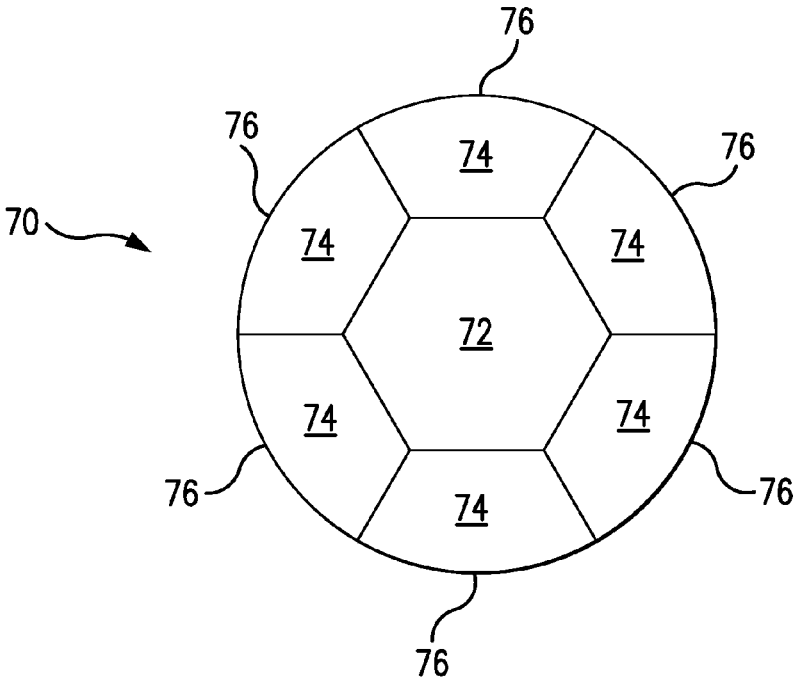
FIG. 12 is a rear elevational view of the composite projectile according to the embodiment of FIG. 11.
Figure 13:
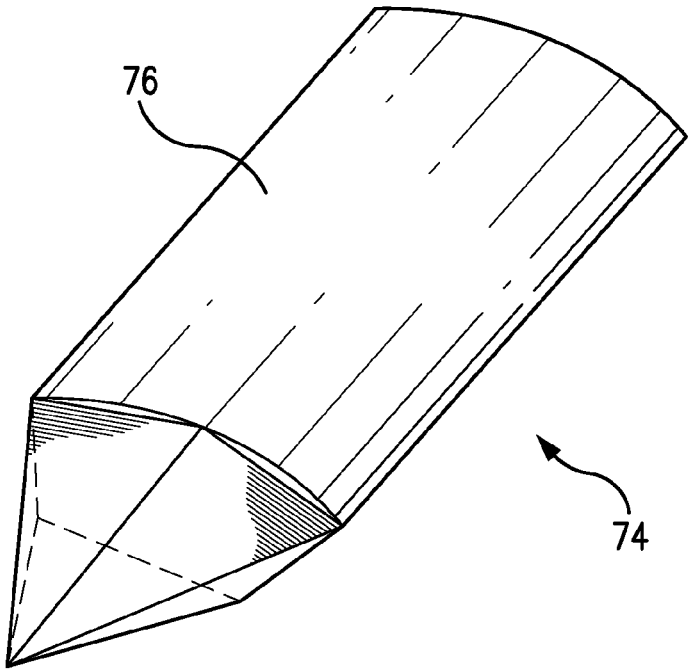
FIG. 13 is a front, top perspective view of a single flechette taken from the composite projectile bundle shown in FIG. 11.
Figure 14:
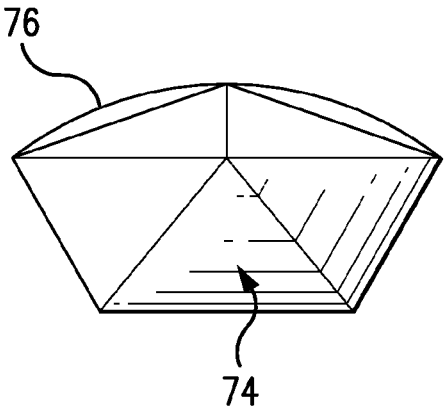
FIG. 14 is a front end elevational view of the single flechette of FIG. 13.
Figure 15:
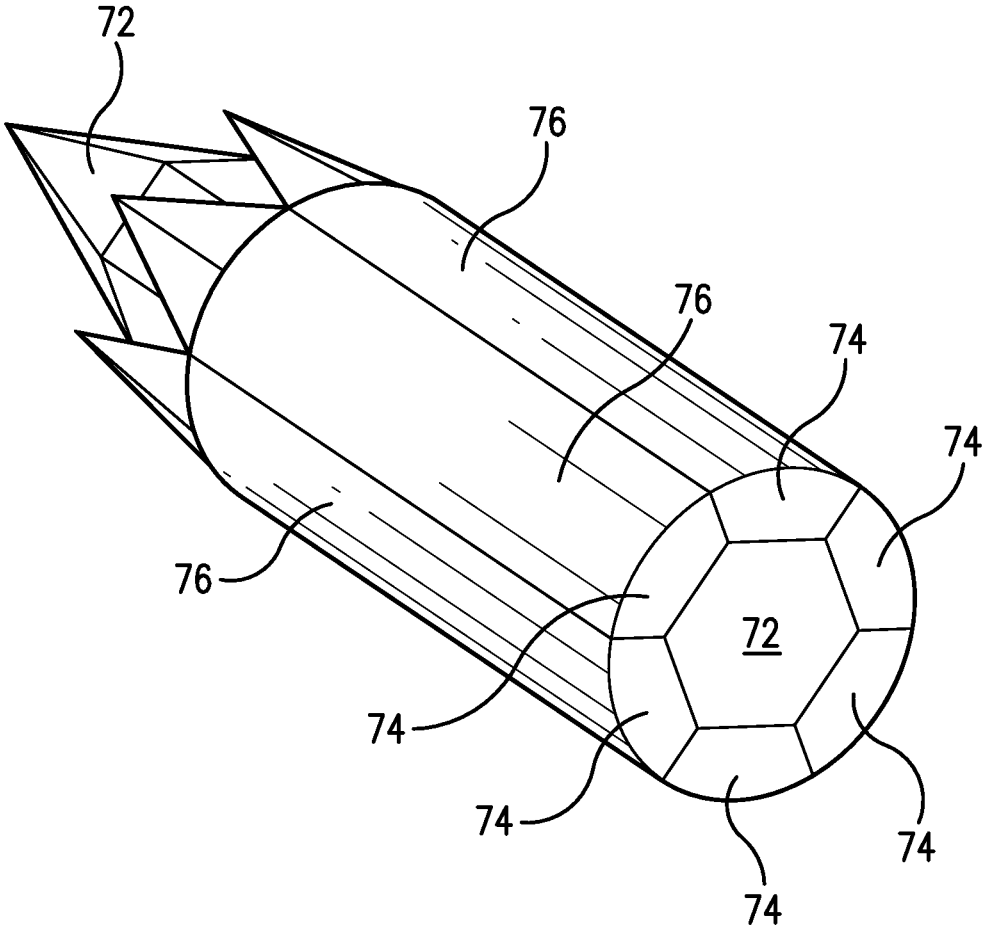
FIG. 15 is a rear perspective view of the composite projectile of FIG. 11.

Additional reference is now made to FIG. 12. The composite projectile of FIG. 11 is shown in front elevational view. Of particular notice is the circular shape caused by the alignment of multiple side flechettes 74 together around the core flechette 72. Each side flechette 74 has a rounded, outer surface 76 such that when formed into the composite projectile 70, the composite projectile 70 has a rounded outer surface. The rounded outer surface of the composite projectile 70 minimizes the radial spinning of the composite projectile 70 during the projection from a weapon, at which time the individual projectile 20 is caused to spin by the passing down the bore 230 of a weapon. In the embodiment of FIGS. 11-12, radial spinning of the composite projectile 70 may be desired to be minimized because the side flechettes 74 may not be adhered to each other or to the core flechette 72. In this way, the side flechettes 74 may separate from each other during flight, before impacting on a target, thereby impacting a target at multiple locations, similar to a shotgun projectile. In one or more embodiments, the composite projectile 70 and associated individual projectile 20 may be fitted to the size of a .45 ACP or a .45 Colt round of ammunition.

The individual projectile 20 and the composite projectile 30 travel along ballistic trajectories once fired. A ballistic trajectory is the path that a projectile takes after a propulsive force is terminated and the projectile is acted on by gravity and aerodynamic drag. In some embodiments, the ballistic trajectory of the composite projectile 30 may be made similar or identical to the ballistic trajectory of the individual projectile 20. In some embodiments, ballistic properties (properties having to do with the velocity or the ballistic trajectory of the projectile) of one or both projectile may be changed by changing one or more physical properties of one or more components of the projectile assembly 10. More specifically, in some embodiments, ballistic properties of one or both projectiles may be changed by changing the diameter and/or the length and/or the weight of those projectiles. Additionally, in some embodiments, ballistic properties of one or both projectiles may be changed by changing the amount of the propellant 40 used and/or by changing the burn rate of the propellant 40.

In any of the aforementioned embodiments or other potential embodiments, a cap may be included to cover the side flechettes in order to cover the gap between the tips of the side flechettes 34/74 and the tip of the core flechette 32/72. The cap would help reduce aerodynamic drag while the projectile assembly 10 is in flight, and would help to separate the side flechettes 34/74 from the core flechette 32/72 after impact with a target. The cap may have a hole in its center to allow the core flechette 32/72 to protrude. The shape of the cap may be changeable in order to alter the aerodynamic properties of the composite projectile 30/70 and such shapes may include but are not limited to rounded, ogive, or conical. The cap may be made from any suitable material. In some embodiments, the cap may be made from a plastic material. Other materials are also envisioned as being potentially useful and possible for the cap. The shape of the cap may be changed or altered in any way to provide any necessary tuning to any attributes of the projectile assembly without deviating from the scope of the claims.

In any of the aforementioned embodiments or other potential embodiments, the core flechette 32/72 and/or the side flechettes 34/74 may be made from Tungsten. Being made from Tungsten may, in the embodiments in which it is used as the material for any flechettes, possibly increase the capability of the flechettes to cause additional damage to an impacted target.

Throughout the detailed description and the accompanying drawings enclosed herein, some embodiments have been shown, described and detailed, wherein a variety of possible elements and/or features may be formed and configured in different ways. Accordingly, any and all possible combinations of the elements and/or features described in accordance with these various embodiments may be desirable to manufacturers and/or may help to more successfully meet customers' specific needs and/or preferences. Consequently, any and all possible combinations of the features or elements of one embodiment or more than one embodiment or all embodiments mentioned herein are fully considered within the spirit and scope of the attached claims and their legal equivalents.

Thus, some embodiments of the tandem nested projectile assembly have been disclosed. Other embodiments are contemplated and envisioned, and therefore it is recognized that departures from the embodiments described in this disclosure may certainly exist within the spirit and scope of the attached claims and their legal equivalents. Those having an ordinary skill in the will envision other possible variations and modifications to features and/or elements of the embodiments, and they will envision other possible embodiments, all of which may fall within the spirit and scope of the attached claims. The spirit and scope of the attached claims is therefore NOT limited by the descriptions and illuminations of the embodiments that have already been presented, but rather the spirit and scope can only be defined by the attached claims and their legal equivalents as interpreted under the doctrine of equivalents. Variations, alternatives, adjustments, modifications, tunings, and deviations from the embodiments of the instant disclosure are fully contemplated and envisioned within the spirit and scope of the attached claims.

What is claimed is:

1. A projectile assembly capable of being projected from a weapon having at least a barrel, the projectile assembly comprising:

an individual projectile having an interior cavity defining a communicating portion;

a composite projectile comprising a plurality of flechettes arranged in a bundle, the composite projectile at least partially received within the communicating portion of the individual projectile prior to the projection of the projectile assembly from the weapon;

a propellant within the communicating portion of the individual projectile and forward of the composite projectile, and the propellant capable of being detonated to increase pressure within the communicating portion and apply a force to the individual projectile in one direction and a simultaneous force to the composite projectile in an opposite direction to cause separation of the individual projectile from the composite projectile after the projectile assembly has been projected from the barrel of the weapon; and a primer located adjacent to the propellant within the communicating portion of the individual projectile and forward of the composite projectile, and the primer being structured to detonate upon at least one of the flechettes of the composite projectile moving forward with the communicating portion and striking the primer when the projectile assembly is projected from the weapon, and wherein detonation of the primer causes detonation of the propellant.

2. The projectile assembly as recited in claim 1 wherein the projection of the projectile assembly causes both of the individual projectile and the composite projectile to travel along their own respective ballistic trajectories, and wherein the ballistic trajectory of the composite projectile may be common to the ballistic trajectory of the individual projectile for any projection of the projectile assembly.

3. The projectile assembly as recited in claim 2 wherein the ballistic trajectory of the composite projectile may be made identical to the ballistic trajectory of the individual projectile for any projection of the projectile assembly.

4. The projectile assembly as recited in claim 3 wherein one or more properties of one or more components of the projectile assembly may be changed, and wherein the changes to the properties may change one or more ballistic properties of one or both of the individual projectile and the composite projectile.

5. The projectile assembly as recited in claim 4 wherein one or more ballistic properties of at least one of the individual projectile and the composite projectile may be changed by the changing at least one of the diameter, the length, and the weight of at least one of the individual projectile and the composite projectile, and wherein the core and side flechettes of the composite projectile have at least one of a predetermined size and projection speed that increase the capability of the flechettes to penetrate their target, and wherein the flechettes have a predetermined mass that increases the likelihood that the flechettes will come to rest while still inside their target as opposed to traveling entirely through their target.

6. The projectile assembly as recited in claim 5 wherein the individual projectile defines an anti-personnel projectile having a structure and being made from a material, wherein both of the structure and the material have properties that contribute to increasing the deformation of the individual projectile when the projected individual projectile impacts on a target, and wherein increasing the deformation of the individual projectile increases the capability of the anti-personnel projectile to damage the target, and further wherein a portion of the individual projectile has a scored surface having multiple scores, wherein the scores increase the likelihood that the individual projectile will separate into multiple fragments upon impact with the target thereby increasing the capability of the anti-personnel projectile to damage the targets.

7. The projectile assembly as recited in claim 6 wherein the composite projectile defines an anti-personnel flechette bundle comprising:

a core flechette having a conical tip; and a plurality of side flechettes each having chisel tips, the side flechettes fitting with the individual projectile such that when the individual projectile is rotated, the composite projectile is rotated as well, and upon impact with a target, the side flechettes separate from the core flechette and each disperse and travel along separate paths through the target, wherein the chisel tip of each side flechette increases the capability of the side flechette to separate from the core flechette and to disperse throughout the target, wherein the separation and the dispersion of the side flechettes increases the capability of the composite projectile to damage the impacted target.

8. The projectile assembly as recited in claim 7 wherein the core flechette and the plurality of side flechettes are all made from Tungsten.

9. The projectile assembly as recited in claim 8 wherein the use of Tungsten as the material for the core flechette and the side flechettes increases the capability of the core and side flechettes to damage a target.

10. The projectile assembly as recited in claim 9 wherein one or more of the multiple-purpose projectile assemblies may be loaded into one or more cartridges and subsequently projected from the weapon, and wherein the operations of both loading the projectile assembly into the cartridge and projecting the projectile assembly from the weapon do not require any modifications to the cartridge or the weapon.

11. The projectile assembly as recited in claim 10 wherein the cartridge defines a 7.62 mm caliber cartridge and the weapon defines a 7.62 mm caliber weapon.

12. The projectile assembly as recited in claim 1 wherein the propellant defines a base bleed gas generator capable of generating base bleed gas, and wherein the base bleed gas causes the individual projectile to experience less drag while the individual projectile is in motion.

13. The projectile assembly as recited in claim 12 wherein the base bleed gas is capable of increasing the range of the individual projectile.

14. The projectile assembly as recited in claim 13 wherein one or more ballistic properties of one or both of the individual projectile and the composite projectile may be changed by the changing of the amount of the propellant and/or by the changing of the burn rate of the propellant.

15. The projectile assembly as recited in claim 14 wherein the cartridge defines a 7.62 mm caliber cartridge and the weapon defines a 7.62 mm caliber weapon.

16. The projectile assembly as recited in claim 15 further including:

a cap for covering a portion of the composite projectile that covers the gap between the tips of the side flechettes and the core flechette, thereby reducing the drag experienced by the composite projectile, the cap also increasing the capability of the side flechettes to disperse from the core flechette upon impact with a target.

17. A projectile assembly for penetrating and damaging targets, the projectile assembly capable of being fired from a weapon having at least a barrel, a bore, a chamber, and a muzzle, the projectile assembly comprising:

an individual projectile defining an anti-personnel projectile having a pre-determined structure, the individual projectile being made from a soft metal, both of the soft metal material and the structure of the individual projectile having properties that contribute to increasing the deformation of the individual projectile when the projected anti-personnel projectile impacts on a target, the increased deformation increasing the capability of the anti-personnel projectile to damage soft targets, and the individual projectile having a cavity therein, the cavity having a scored surface having multiple scores, the scores increasing the likelihood that the individual projectile will separate into multiple fragments upon impact with a target, the separation of the individual projectile into fragments upon impact with a target further increasing the capability of the anti-personnel projectile to damage soft targets, and the projection of the anti-personnel projectile causing the anti-personnel projectile to travel along a ballistic trajectory, both of the ballistic trajectory and the speed at which the anti-personnel projectile travels along the ballistic trajectory being changeable in response to a change in the diameter and/or the length and/or the weight and/or the shape of the anti-personnel projectile;

a composite projectile defining an anti-personnel flechette bundle comprising:

a core flechette having a conical tip; and a plurality of side flechettes each having chisel tips, and wherein the side flechettes are attached to the core flechette using a low strength adhesive, the adhesive being capable of withstanding the centrifugal forces of spinning and high-speed projectile flight but not capable of withstanding impact with a target, such that upon impact with a target, the side flechettes separate from the core flechette and each disperse and travel along separate paths through the target, wherein the chisel tip of each side flechette increases the capability of the side flechette to separate from the core flechette and to disperse throughout the target, wherein the separation and the dispersion of the side flechettes increases the capability of the composite projectile to damage the impacted target;

wherein both the conical and all of the side flechettes are made from Tungsten, the use of Tungsten as the material for the flechettes increasing the capability of the flechettes to damage their target;

wherein the core and side flechettes have at least one of a predetermined size and projection speed that increase the capability of the flechettes to penetrate their target, and wherein the core and side flechettes have a predetermined mass that increases the likelihood that the flechettes will come to rest while still inside their target as opposed to traveling entirely through their target;

wherein the composite projectile is at least partially contained within the cavity of the individual projectile prior to projection, and wherein the side flechettes fit into the scores of the individual projectile such that when the individual projectile is rotated, the composite projectile is rotated as well, and the projection of the composite projectile causing the simultaneous projection of the individual projectile and causing the composite projectile to travel along a ballistic trajectory that is the same as the ballistic trajectory of the individual projectile, the result of both of the projectiles having the same ballistic trajectory being that both of the projectiles impact upon the same target at the termination of their ballistic trajectories, both of the ballistic trajectory of the composite projectile and the speed at which the composite projectile travels along its ballistic trajectory being changeable in response to a change in the diameter and/or the length and/or the weight and/or the shape of the composite projectile;

a propellant housed within the cavity of the individual projectile and located between the individual projectile and the composite projectile that is capable of being detonated, the detonation of the propellant causing an increase in the pressure of the cavity of the individual projectile, the increased cavity pressure applying a force in the forward direction to the individual projectile and applying a force in the opposite direction of the projectile assembly's trajectory to the composite projectile, causing the composite projectile to withdraw from the cavity of the individual projectile immediately after the projectile assembly has left the bore of the weapon, the withdrawal of the composite projectile from the cavity defining an increase in the separation between the individual projectile and the composite projectile, the detonation of the propellant causing the propellant to burn, and the amount of the propellant and/or the burn rate of the propellant being changeable, the changing of the amount and/or the burn rate of the propellant having the capability to change the ballistic trajectories of both of the anti-personnel projectile and the composite projectile and the speeds at which those projectiles travel along their respective trajectories;

a base bleed gas generated by the burning of the propellant, the propellant defining a base bleed gas generator, the base bleed gas being released into the cavity of the individual projectile and subsequently filling the cavity and expanding outwards from the cavity, the base bleed gas increasing the pressure of any space that it fills, and the base bleed gas causing the anti-personnel projectile to experience less drag while the anti-personnel projectile is in motion, the anti-personnel projectile being capable of travelling a farther distance due to experiencing less drag;

a primer that is capable of being detonated, the primer housed within the cavity of the individual projectile and located adjacent to the propellant, the detonation of the primer causing the detonation of the propellant, the detonation the primer being caused by the projecting of the composite projectile, due to the projecting of the composite projectile causing the composite projectile to make contact with the primer, and the primer defining an explosive sensitive enough to detonate as a result of the composite projectile making contact with the primer.

18. The projectile assembly as recited in claim 17, one or more of the projectile assemblies being capable of being loaded into a weapon cartridge and subsequently projected from the weapon, the operation of both loading into the cartridge and projecting from the weapon not requiring any modifications of the cartridge or the weapon.

19. The projectile assembly as recited in claim 18, the cartridge defining a 7.62 mm caliber cartridge and the weapon defining a 7.62 mm caliber weapon.

20. The projectile assembly as recited in claim 19 further including:

a cap for covering a portion of the composite projectile that covers the gap between the tips of the side flechettes and the core flechette, thereby reducing the drag experienced by the composite projectile, the cap also increasing the capability of the side flechettes to disperse from the core flechette upon impact with a target.

21. The projectile assembly as recited in claim 17 wherein the composite projectile defines an anti-personnel flechette bundle comprising:

a core flechette having a conical tip; and a plurality of side flechettes each having a predetermined tip shape, the shape of the tip being changeable in order to change the rate of dispersion of the side flechettes from the core flechette during projectile flight, the six side flechettes separating from the core flechette during projectile flight prior to impact with a target, such that each side flechette's ballistic trajectory terminates at a different location, wherein the shape of the tip of each side flechette changes the capability of the side flechettes to separate from the core flechette and to disperse throughout the target, wherein the separation and the dispersion of the side flechettes increases the capability of the composite projectile to damage the impacted target or targets.

22. The projectile assembly as recited in claim 21 wherein the side flechettes include a curved surface such that when they are oriented in a flechette bundle radially around the core flechette, the curved surfaces align to form a smooth, rounded exterior surface of the flechette bundle, the rounded exterior surface reducing the capability of the individual projectile to cause the composite projectile to spin radially after the projectile assembly is projected, thereby increasing the accuracy of the flechette bundle against a target.

23. The projectile assembly as recited in claim 22 wherein the core flechette and the plurality of side flechettes are all made from Tungsten.

24. The projectile assembly as recited in claim 23 wherein the use of Tungsten as the material for the core flechette and the side flechettes increases the capability of the core and side flechettes to damage a target.

25. The projectile assembly as recited in claim 24 wherein one or more of the multiple-purpose projectile assemblies may be loaded into one or more cartridges and subsequently projected from the weapon, and wherein the operations of both loading the projectile assembly into the cartridge and projecting the projectile assembly from the weapon do not require any modifications to the cartridge or the weapon.

26. The projectile assembly as recited in claim 25 wherein the cartridge may define at least one of a .45 Colt cartridge and a .45 ACP cartridge.

27. The projectile assembly as recited in claim 26 wherein the weapon defines any weapon capable of firing at least one of a .45 Colt cartridge and a .45 ACP cartridge.

28. The projectile assembly as recited in claim 25 wherein the propellant defines a base bleed gas generator capable of generating base bleed gas, and wherein the base bleed gas causes the individual projectile to experience less drag while the individual projectile is in motion.

29. The projectile assembly as recited in claim 28 wherein the base bleed gas is capable of increasing the range of the individual projectile.

30. The projectile assembly as recited in claim 29 wherein one or more ballistic properties of one or both of the individual projectile and the composite projectile may be changed by the changing of the amount of the propellant and/or by the changing of the burn rate of the propellant.

31. The projectile assembly as recited in claim 30 wherein the cartridge may define at least one of a .45 Colt cartridge and a .45 ACP cartridge.

32. The projectile assembly as recited in claim 31 wherein the weapon defines any weapon capable of firing at least one of a .45 Colt cartridge and a .45 ACP cartridge.

* * * * *